United States Patent [19]

Sandorf

[11] 4,376,545

[45] Mar. 15, 1983

[54] SKI BRAKE

[76] Inventor: Åke Sandorf, Örngränd 3, 951 47 Luleå, Sweden

[21] Appl. No.: 214,787

[22] Filed: Dec. 9, 1980

[51] Int. Cl.[3] ..... A63C 7/10

[52] U.S. Cl. ..... 280/605; 188/6; 188/8; 267/158

[58] Field of Search ..... 280/604, 605; 188/6, 188/8; 267/158

[56] References Cited

U.S. PATENT DOCUMENTS

| | | | |
|---|---|---|---|
| 3,192,551 | 7/1965 | Appel | 267/158 X |
| 3,566,899 | 3/1971 | Bowditch | 267/158 X |
| 3,873,108 | 3/1975 | Lacarrau et al. | 280/605 |

FOREIGN PATENT DOCUMENTS

| | | | |
|---|---|---|---|
| 2551802 | 6/1977 | Fed. Rep. of Germany | 280/605 |
| 591872 | 9/1977 | Switzerland | 280/605 |

*Primary Examiner*—Joseph F. Peters, Jr.
*Assistant Examiner*—Michael Mar
*Attorney, Agent, or Firm*—Le Blanc, Nolan, Shur & Nies

[57] ABSTRACT

A ski brake, which is mounted on the ski and provided with two brake arms, one on each side of the ski, which brake arms by spring action can be turned to a catching position, in which the brake arms extend downward, substantially perpendicularly to the ski.

The invention is characterized in that the ski brake consists of single piece of material, and the resilience is obtained by utilizing the design of the sheet metal material, a.o. reinforcing grooves.

5 Claims, 4 Drawing Figures

SKI BRAKE

Figure 1:
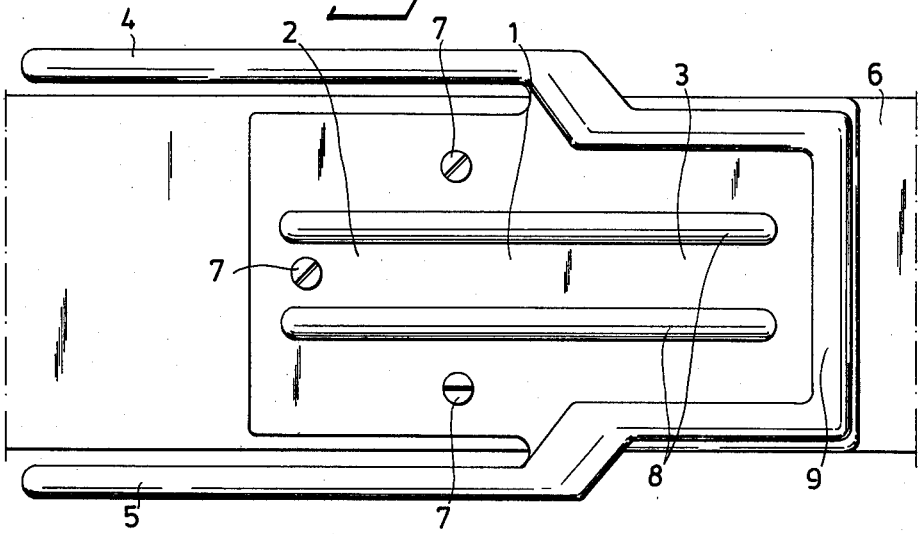

This invention relates to a ski brake comprising two brake arms, which are located on both sides of the ski and by spring action can be turned to a catching position, in which the brake arms extend downward substantially perpendicularly to the ski.

Ski catching devices in the form of catching and, respectively, safety straps are known, the object of which is to prevent the ski sliding uncontrolled down the course when the ski is separated from the skier's boot.

These known devices, however, are dangerous, because the skier after having fallen draws along the ski, which thereby can injure the skier. The injuries can often be very serious and cannot safely be prevented by these known devices.

In order to overcome these shortcomings, brake devices have been developed, by which the ski is prevented from sliding by means of pivotal levers or yokes. When the ski is being used, spring-actuated stop members are held by the boot in position not objecting the ski to slide. When the ski is separated from the boot, the stop members assume a catching position, in which they extend downward substantially perpendicularly to the ski.

Many of these known devices, however, cannot or only with difficulty be applied in practice, because the turning mechanism proper is located perpendicularly to the ski on the upper surface thereof.

Modern ski boots have flat soles and, therefore, do not leave space beneath them for taking up such a turning mechanism. A prerequisite for using such a catching device is the location of the braking device substantially behind the ski boot, i.e. also behind the ski binding. The total design thereby is given considerable dimensions, resulting in a disturbing effect when the ski is being used, and in an impeding effect when the ski is being carried, because the outer ski configuration is affected by said design.

Other known devices are provided with tension springs on the brake arms proper, which thereby are given considerable dimensions. The results are as stated above.

The conventional ski brakes comprise several different structural members, and the conventional technique of manufacturing ski brakes includes bendng of wire or bar material, punching and embossing discs, plastic moulding and a complicated assembling method, which in most cases including the mounting of springs.

The present invention relates to a ski brake comprising a bottom plate, which comprises an attachment plate to be mounted on the upper surface of the ski and a thrust plate, and two brake arms, which are connected to each other and to the thrust plate and are located in the same plane as and on both sides of the thrust plate, which brake arms by spring action can be turned to a braking position, in which the brake arms extend downward substantially perpendicularly to the ski. The invention is characterized in that the bottom plate consists of a single piece of thin sheet metal, which is provided with grooves in the longitudinal direction of the ski, that the bottom plate in unloaded state is bent transversely to the longitudinal direction so that an angle is formed between the attachment plate and the thrust plate, and that the bottom plate is elastically flexible against its own spring action so as to be substantially the plane.

The present invention, thus, eliminates the aforesaid inexpedient properties of the known catching devices. The ski brake according to the present invention is manufactured as a one-piece thin metal sheet having a thickness of between 0.7 and 1.3 mm, preferably 1 mm. By utilizing the material properties of the metal sheet in combination with its design, the ski brake can be given desired properties with respect to its function, i.e. its stiffness and resilience, and to its design. The ski brake according to the invention is also much cheaper to manufacture than other commercially availavle types, because it consists of a single material piece, which is formed by pressing and does not imply a mounting method.

At another embodiment the brake arms are manufactured separately and mounted on the ski brake.

Figure 2:
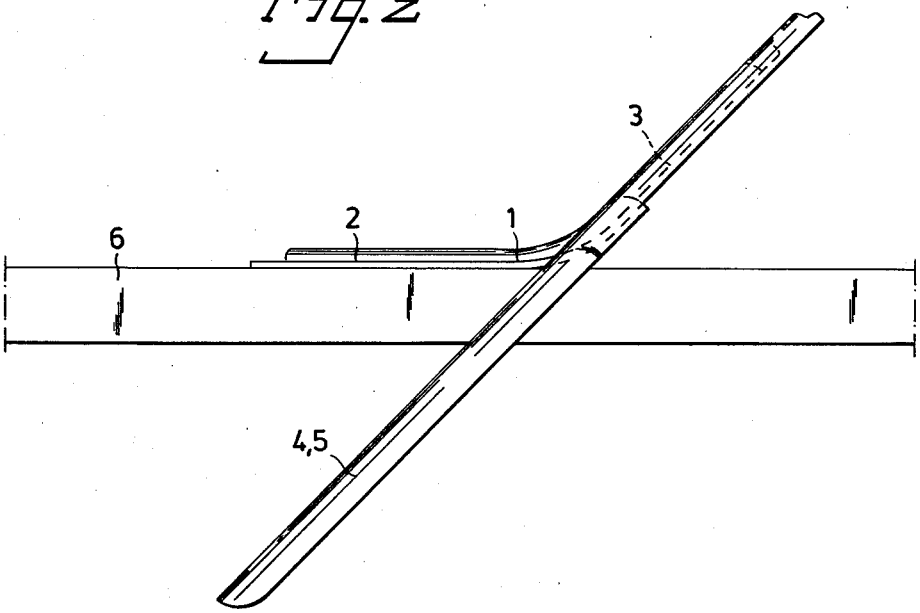
Figure 3:
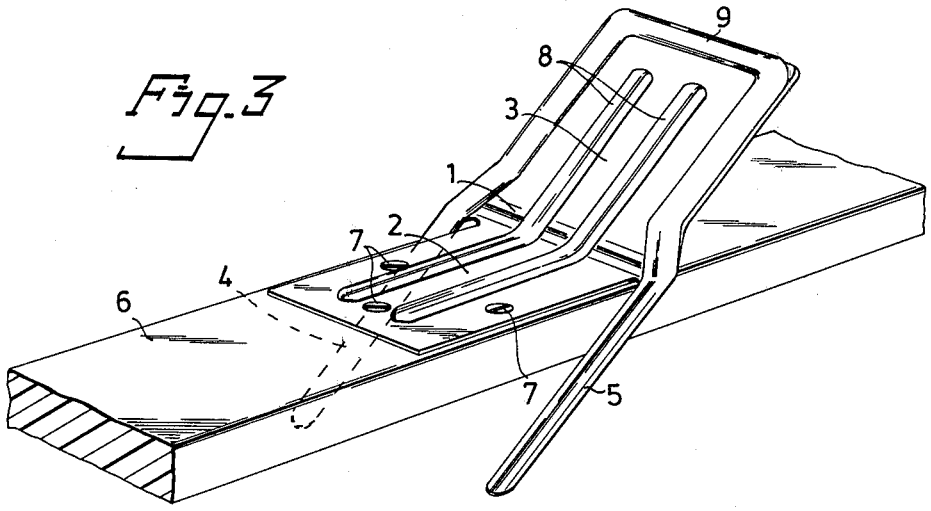
Figure 4:
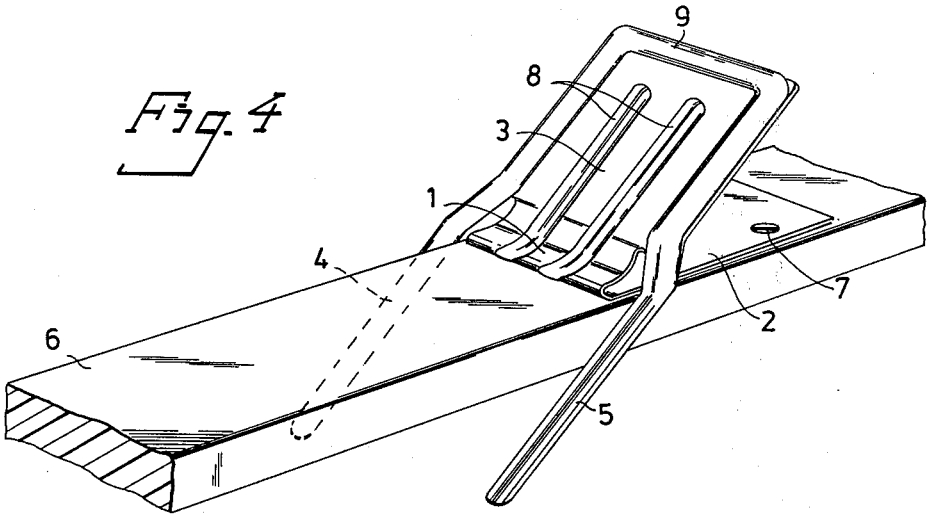

The invention is described in the following, with reference to the accompanying drawings, in which FIG. 1 is a view of a ski brake according to the invention seen from above, the brake being non-operative and mounted on a ski, FIG. 2 shows the ski brake in operative position, FIG. 3 is a perspective view of the ski brake in operative position, and FIG. 4 is a perspective view of another embodiment of the invention in operative position.

The ski brake according to the invention comprises a bottom plate, 1 which consists of an attachment plate 2 and a thrust plate 3. The attachment plate 2 is mounted on the ski 6, preferably by screws 7. The ski brake further comprises two brake arms 4, 5 located on both sides of the ski 6.

The bottom plate 1 is provided with reinforced longitudinal grooves 8, which may vary in number and length. The bottom plate 1 further is curved so that the attachment plate 2 and thrust plate 3 form an angle with one another.

The brake arms 4,5 are interconnected by a U-shaped yoke 9. The brake arms and the yoke have U-, V- or tube-shaped cross-section. The brake arms, the yoke and the bottom plate are manufactured as a single-piece member, preferably by pressing. Alternatively, the bottom plate is manufactured as one single piece, and the brake arms and yoke are manufactured separately, whereafter the details are jointed, preferably by riveting or spot welding.

FIG. 3 is a perspective view of the ski brake in operative position, mounted on a ski. When a ski boot is clamped on the ski, the thrust plate 3 is bent down to the ski, and the brake arms 4,5 assume skiing position in parallel with the ski. When the ski boot disengages from the ski, the bottom plate due to the resilience of the material is bent upward, and the brake arms thereby assure operative position, i.e. brake the ski.

The ski brake is manufactured of a material having the necessary elastic properties, which material preferably is stainless. The necessary resilience properties are obtained by a suitable material choice in combination with reinforced grooves 8, the reinforced cross-sections of the brake arms 4,5 and of the yoke 9 and of the bending between the attachment plate 2 and the thrust plate 3.

The advantage of the catching device according to the invention is apparent. The device renders possible simplicity of handling and of construction, whereby the manufacturing costs can be held low.

The invention must not be regarded restricted to the embodiments described above, but can be varied within the scope of the attached claims, without abandoning the idea of the invention.

I claim:

1. A ski brake, comprising: a bottom plate made from flexible sheet material which in its turn comprises an attachment plate portion adapted to be mounted on the upper surface of a ski and a thrust plate portion structurally integral with the attachment plate portion and two brake arms connected to and integral with the thrust plate portion and located in the same plane as on both sides of the thrust plate portion, which brake arms by spring action between said two plate portions can be turned to a braking position, in which the brake arms extend downwardly to a position below the ski, characterized in that the bottom plate consists of a single piece of thin sheet metal, which is provided with longitudinal deformation grooves extending between and into both plate portions in the longitudinal direction of the ski, the bottom plate in unloaded state is bent transversely to the longitudinal direction so that an angle is formed between the attachment plate portion and the thrust plate portion, that the bottom plate is elastically flexible against its own resilience enabling it to be flexed to a substantially plane condition, and that the sheet metal material along said brake arms and extending between said brake arms across said thrust plate portion has a deformation contour providing stiffness in said thrust plate portion and said brake arms.

2. A ski brake as defined in claim 1, characterized in that said longitudinal grooves, the brake arms and the the thrust plate portion (9) extending therebetween have a upstanding profiled cross-section.

3. A ski brake as defined in claim 1 or 2 wherein the sheet metal thickness is from 0.7 mm to 1.3 mm.

4. A ski brake as defined in claim 1 wherein said angle is obtuse.

5. A ski brake as defined in claim 1 wherein said angle is acute.

* * * * *

UNITED STATES PATENT AND TRADEMARK OFFICE

CERTIFICATE OF CORRECTION

PATENT NO. : 4,376,545

DATED : March 15, 1983

INVENTOR(S) : Ake Sandorf

It is certified that error appears in the above—identified patent and that said Letters Patent is hereby corrected as shown below:

Column 1, line 49 "bendng" should be --bending--.

, line 52 "including" should be --includes--.

Coulmn 2, line 1, "the" should be deleted.

Claim 1, column 3, line 12, insert --and-- between the words "as" and "on".

, column 4, line 12, "(9)" should be deleted.

, line 13, "a" should be --an--.

Signed and Sealed this

Tenth Day of May 1983

[SEAL]

*Attest:*

GERALD J. MOSSINGHOFF

*Attesting Officer*

*Commissioner of Patents and Trademarks*